US009599940B2

(12) United States Patent
Yamano et al.

(10) Patent No.: US 9,599,940 B2
(45) Date of Patent: Mar. 21, 2017

(54) FIXING DEVICE WITH NIP FORMING MEMBER HAVING A HIGH THERMAL-CONDUCTIVE LAYER WITH A LOW THERMAL CONDUCTIVE PORTION

(71) Applicants: Motoyoshi Yamano, Tokyo (JP); Kohichi Utsunomiya, Kanagawa (JP); Hiromasa Takagi, Tokyo (JP); Kenji Ishii, Kanagawa (JP); Takayuki Seki, Kanagawa (JP); Keitaro Shoji, Kanagawa (JP); Hideo Nagafuji, Kanagawa (JP); Yuji Arai, Kanagawa (JP); Arinobu Yoshiura, Kanagawa (JP); Shohei Saito, Kanagawa (JP); Qifeng Cui, Tokyo (JP); Yutaka Ikebuchi, Kanagawa (JP)

(72) Inventors: Motoyoshi Yamano, Tokyo (JP); Kohichi Utsunomiya, Kanagawa (JP); Hiromasa Takagi, Tokyo (JP); Kenji Ishii, Kanagawa (JP); Takayuki Seki, Kanagawa (JP); Keitaro Shoji, Kanagawa (JP); Hideo Nagafuji, Kanagawa (JP); Yuji Arai, Kanagawa (JP); Arinobu Yoshiura, Kanagawa (JP); Shohei Saito, Kanagawa (JP); Qifeng Cui, Tokyo (JP); Yutaka Ikebuchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/657,656

(22) Filed: Mar. 13, 2015

(65) Prior Publication Data

US 2015/0261157 A1 Sep. 17, 2015

(30) Foreign Application Priority Data

Mar. 17, 2014 (JP) ..... 2014-053225
Apr. 30, 2014 (JP) ..... 2014-093882

(51) Int. Cl.
*G03G 15/20* (2006.01)

(52) U.S. Cl.
CPC ..... *G03G 15/2053* (2013.01); *G03G 15/2028* (2013.01); *G03G 15/2042* (2013.01); *G03G 2215/2035* (2013.01)

(58) Field of Classification Search
CPC ..... G03G 15/2053; G03G 15/2057; G03G 15/2042
(Continued)

(56) References Cited

U.S. PATENT DOCUMENTS

2010/0098468 A1* 4/2010 Lee ..... G03G 15/2053 399/329
2013/0170879 A1 7/2013 Yoshinaga et al.
(Continued)

FOREIGN PATENT DOCUMENTS

JP 2004-235001 8/2004
JP 2008-107390 5/2008
(Continued)

OTHER PUBLICATIONS

U.S. Appl. No. 14/531,313, filed Nov. 3, 2014.
U.S. Appl. No. 14/467,135, filed Aug. 25, 2014.
U.S. Appl. No. 14/467,341, filed Aug. 25, 2014.

*Primary Examiner* — Walter L Lindsay, Jr.
*Assistant Examiner* — Arlene Heredia Ocasio
(74) *Attorney, Agent, or Firm* — Oblon, McClelland, Maier & Neustadt, L.L.P.

(57) ABSTRACT

A fixing device includes: a fixing member that is rotatable and in an endless shape; a heat source that heats the fixing member; a nip forming member that is arranged inside the fixing member; and a pressurizing member that is pressurized to be in contact with the nip forming member through the fixing member, to form a fixing nip. The fixing device fixes an unfixed image on a recording medium by passing
(Continued)

the recording medium that carries the unfixed image through the fixing nip. The nip forming member includes a base layer, and a high thermal-conductive layer that is arranged on a surface layer of the base layer on a fixing nip side, and that has higher thermal conductivity than the base layer, and in the high thermal-conductive layer, a low thermal-conductive portion is arranged near an end portion in an axial direction of the fixing member.

16 Claims, 7 Drawing Sheets

(58) Field of Classification Search
USPC ..... 399/329
See application file for complete search history.

(56) References Cited

U.S. PATENT DOCUMENTS

| | | | | |
|---|---|---|---|---|
| 2013/0279955 | A1* | 10/2013 | Maeda ..... | G03G 15/2053 399/329 |
| 2015/0055993 | A1 | 2/2015 | Shoji | |
| 2015/0055994 | A1 | 2/2015 | Shoji et al. | |

FOREIGN PATENT DOCUMENTS

| | | | |
|---|---|---|---|
| JP | 2010-032631 | | 2/2010 |
| JP | 2013-137470 | | 7/2013 |
| JP | 2015-64560 | A | 4/2015 |
| JP | 2015-64561 | A | 4/2015 |
| JP | 2015-145950 | A | 8/2015 |

* cited by examiner

FIXING DEVICE WITH NIP FORMING MEMBER HAVING A HIGH THERMAL-CONDUCTIVE LAYER WITH A LOW THERMAL CONDUCTIVE PORTION

CROSS-REFERENCE TO RELATED APPLICATIONS

The present application claims priority to and incorporates by reference the entire contents of Japanese Patent Application No. 2014-053225 filed in Japan on Mar. 17, 2014 and Japanese Patent Application No. 2014-093882 filed in Japan on Apr. 30, 2014.

BACKGROUND OF THE INVENTION

1. Field of the Invention

The present invention relates to a fixing device and an image forming apparatus.

2. Description of the Related Art

In recent years, demands for energy-saving and speed-enhancement technologies have been rising in the market for image forming apparatuses such as printers, copiers, and facsimiles.

In image forming apparatuses, an unfixed toner image is formed in an image transfer method or in a direct method on recording materials such as recoding sheets, printing paper, photosensitive paper, and electrostatic recording paper by the image forming process such as electrophotographic recording, electrostatic recording, and magnetic recording. As a fixing device to fix an unfixed toner image, a fixing device based on a contact heating method such as a hot holler method, a film heating method, and an electromagnetic induction heating method is widely used.

Challenges in such a fixing device in recent years include the following.

To further reduce in warmup time that is time required until a predetermined temperature (reload temperature) that enables printing is reached from room temperature at the time of power activation, or first print time that is time requited until printing operation is performed through printing preparation process, and ejection of paper is completed from reception of a print request (Challenge 1).

To solve the problem of so-called temperature drop in which amount of heat becomes insufficient especially at the beginning of continuous printing because with enhanced speed of image forming apparatuses, the sheets of paper fed thereinto per unit time increases and a necessary amount of heat increases (Challenge 2).

To solve the above problems, the applicant of the present application has proposed a fixing device that is configured such that an endless belt having a low heat capacity is directly heated (not through a metallic heat conductor), and that enables to achieve favorable fixability even if equipped in highly productive image forming apparatuses.

However, with a fixing configuration using an endless belt having a low heat capacity, it is difficult to keep the temperature distribution uniform in the longitudinal direction at the time of feeding paper. That is, although heat is consumed in a region in which a recording medium in a small size passes (paper passing region) to heat up the recording medium (a recording sheet and unfixed toner on the recording medium), heat is not lost by a recording medium in a non-paper-passing region. Therefore, heat is accumulated in a heating roller and a belt, and so-called end temperature rise is known to occur in which temperature at a nip portion in this non-paper-passing region becomes higher than temperature at a nip portion in the paper passing region at which temperature is managed to be maintained at predetermined temperature.

To tackle this problem of the end temperature rise, one that is intended to prevent end temperature rise by using a heat-equalization material in a part of a nip forming member that is pressurized to be in contact with a fixing belt to enhance performance in thermal transfer and heat absorption has been proposed.

In Japanese Patent Laid-open Publication No. 2004-235001 (Patent Literature 1), a fixing device in which a fixing member is formed with a heat-resistant film, and a heat-equalization member is arranged on a downstream side of a fixing nip portion is disclosed.

However, for a configuration using a heat-equalization material, there has been a problem in which temperature at an end portion becomes low compared to a central portion at the time of activation of fixing, as tradeoff for preventing occurrence of the end temperature rise.

Therefore, it is desirable to provide a fixing device that enables to prevent occurrence of end temperature rise and to suppress reduction in heat at an end portion at the time of activation.

SUMMARY OF THE INVENTION

It is an object of the present invention to at least partially solve the problems in the conventional technology.

According to an aspect of the present invention, there is provided a fixing device including: a fixing member that is rotatable and in an endless shape; a heat source that heats the fixing member; a nip forming member that is arranged inside the fixing member; and a pressurizing member that is pressurized to be in contact with the nip forming member through the fixing member, to form a fixing nip, and the fixing device fixing an unfixed image on a recording medium by passing the recording medium that carries the unfixed image through the fixing nip, wherein the nip forming member includes a base layer, and a high thermal-conductive layer that is arranged on a surface layer of the base layer on a fixing nip side, and that has higher thermal conductivity than the base layer, and in the high thermal-conductive layer, a low thermal-conductive portion is arranged near an end portion in an axial direction of the fixing member.

According to another aspect of the present invention, there is provided a fixing device including: a pressurizing rotating member that is rotatable and in an endless shape; a nip forming member that is arranged inside the pressurizing rotating member; a fixing member that is pressurized to abut on the nip forming member through the pressurizing rotating member, to form a fixing nip between itself and the pressurizing rotating member; and a heat source that heats the fixing member, and the fixing device fixing an unfixed image on a recording medium by passing the recording medium that carries the unfixed image through the fixing nip, wherein the nip forming member includes a base layer, and a high thermal-conductive layer that is arranged on a surface layer of the base layer on a fixing nip side, and that has higher thermal conductivity than the base layer, and in the high thermal-conductive layer, a low thermal-conductive portion is arranged near an end portion in an axial direction of the fixing member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of the present invention are explained below based on the accompanying drawings.

Figure 1:
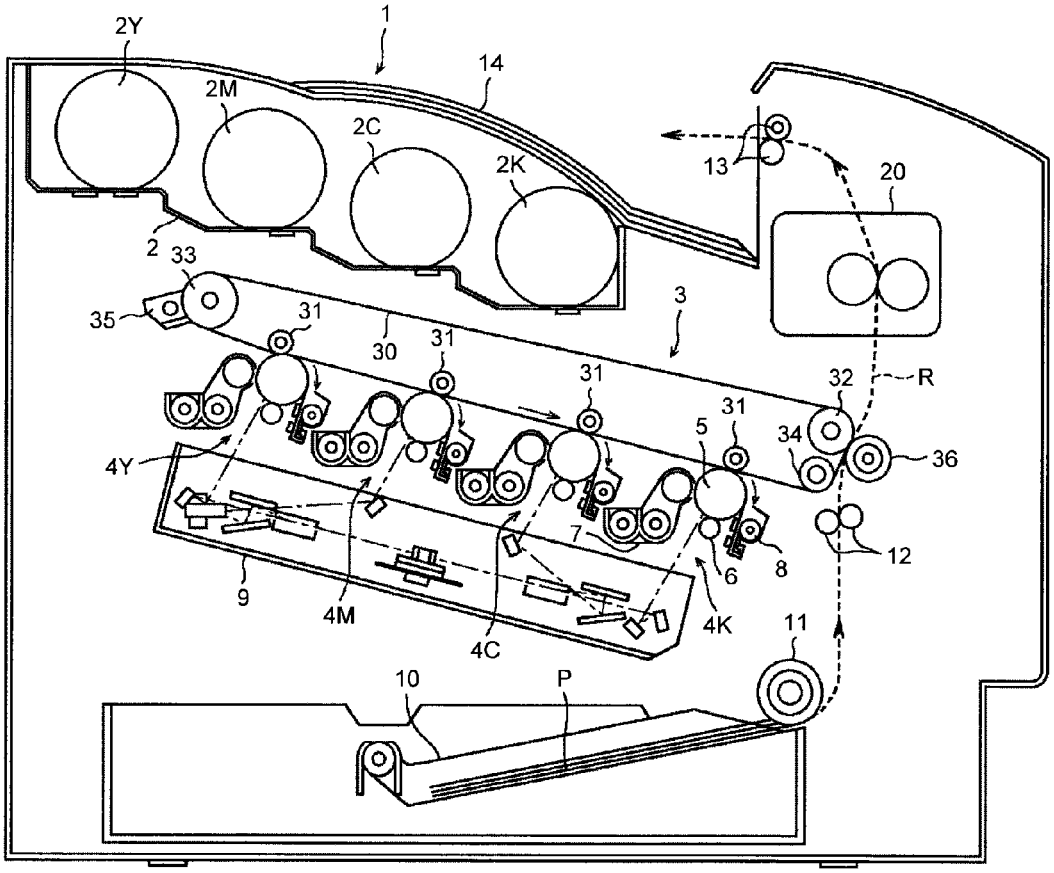
FIG. 1 is a schematic diagram indicating an entire configuration of an image forming apparatus according to one embodiment of the present invention.

FIG. 1 is a schematic diagram indicating an entire configuration of an image forming apparatus according to one embodiment of the present invention.

An image forming apparatus 1 indicated herein is a color laser printer, and has four image forming units 4Y, 4M, 4C, and 4K in a center of a main unit of the apparatus. The respective image forming units 4Y, 4M, 4C, and 4K have the same structure except that different colors of developers in yellow (Y), magenta (M), cyan (C), and black (K) corresponding to color separation components of a color image are contained therein.

Specifically, each of the image forming units 4Y, 4M, 4C, and 4K has a photoconductor 5 in a drum shape as a latent image carrier, a charging device 6 that charges a surface of the photoconductor 5, a developing device 7 that supplies toner on the surface of the photoconductor 5, a cleaning device 8 that cleans the surface of the photoconductor 5 and the like. In FIG. 1, reference numerals are shown only for the photoconductor 5, the charging device 6, the developing device 7, and the cleaning device 8 included in the image forming unit 4K of black, and the reference numerals are omitted for the image forming units 4Y, 4M, and 4C.

Below the respective image forming units 4Y, 4M, 4C, and 4K, an exposing device 9 that exposes the surface of the photoconductor 5 is arranged. The exposing device 9 has a light source, a polygon mirror, an f-O lens, a reflection mirror, and the like, and is configured to irradiate laser beams on the surface of the respective photoconductors 5 based on image data.

Above the respective image forming units 4Y, 4M, 4C, and 4K, a transfer device 3 is arranged. The transfer device 3 has an intermediate transfer belt 30 as a transfer body, four first transfer rollers 31 as a first transfer unit, and a second transfer roller 36 as a second transfer unit. Furthermore, the transfer device 3 has a second-transfer backup roller 32, a cleaning backup roller 33, a tension roller 34, and a belt cleaning device 35.

The intermediate transfer belt 30 is an endless belt, and is held in tension by the second-transfer backup roller 32, the cleaning backup roller 33, and the tension roller 34. In this example, the intermediate transfer belt 30 is arranged to travel around (rotate) in a direction indicated in an arrow in the drawing with rotational drive of the second-transfer backup roller 32.

The four units of the first transfer rollers 31 sandwiches the intermediate transfer belt 30 with the respective photoconductors 5, to form first transfer nips. Moreover, to each of the first transfer rollers 31, an unillustrated power source is connected, and a predetermined direct-current (DC) voltage and/or an alternating-current (AC) voltage are/is applied to each of the first transfer rollers 31.

The second transfer roller 36 sandwiches the intermediate transfer belt 30 with the second-transfer backup roller 32, to form a second transfer nip. Furthermore, similarly to the first transfer roller 31, an unillustrated power source is connected to the second transfer roller 36 also, and a predetermined DC voltage and/or an AC voltage are/is applied to the second transfer roller 36.

The belt cleaning device 35 has a cleaning brush and a cleaning blade that are arranged so as to abut against the intermediate transfer belt 30. An unillustrated waste-toner transfer hose that stretches from this belt cleaning device 35 is connected to an inlet portion of an unillustrated waste toner container.

At an upper part of the printer main unit, a bottle containing unit 2 is arranged, and in the bottle containing unit 2, four toner bottles 2Y, 2M, 2C, and 2K containing supplemental toner are detachably placed. Between the respective toner bottles 2Y, 2M, 2C, and 2K and the respective developing devices 7, a supply channel is arranged, and through this supply channel, toner is supplied to the respective developing devices 7 from the respective toner bottles 2Y, 2M, 2C, and 2K.

On the other hand, at a lower part of the printer main unit, a paper feeding tray 10 in which paper P as a recoding medium is contained, a paper feeding roller 11 that takes out the paper P from the paper feeding tray 10, and the like are arranged. The recording medium includes cardboard, postcards, envelopes, thin paper, coated paper (coated paper, art paper, and the like), tracing paper, overhead transparency sheets, and the like, other than ordinary paper. Moreover, although not illustrated, a manual paper-feeding mechanism may be arranged.

Inside the printer main unit, a transfer route R to eject the paper P outside the apparatus from the paper feeding tray 10 through the second transfer nip is arranged. In the transfer rout R, a pair of registration rollers 12 are arranged as a transfer unit to transfer the paper P to the second transfer nip on an upstream side to the position of the second transfer roller 36 in a paper transferring direction.

Furthermore, on a downstream side to the position of the second transfer roller 36 in the paper transfer direction, a fixing device 20 to fix an unfixed image that has been transferred onto the paper P is arranged. Moreover, on a downstream side to the fixing device 20 in the paper transfer direction in the transfer route R, a pair of paper ejection rollers 13 to eject paper to the outside of the apparatus is arranged. Furthermore, on a top surface of the printer main unit, a paper ejection tray 14 to stock paper ejected to the outside of the apparatus is arranged.

Subsequently, referring to FIG. 1, basic operation of the printer according to the embodiment is explained.

When image forming operation is started, the respective photoconductors 5 in the respective image forming units 4Y, 4M, 4C, and 4K are rotated in a clockwise direction in the drawing by an unillustrated driving device, and the surfaces of the respective photoconductors 5 are charged uniformly to a predetermined polarity by the charging device 6. To the charged surfaces of the respective photoconductors 5, laser beams are irradiated from the exposing device 9, respectively, and electrostatic latent images are formed on the surface of the respective photoconductors 5. Image data exposed on the respective photoconductors 5 at this time is image data of a single color that is obtained by separating a desired full color image into color data of yellow, magenta, cyan, and black. By supplying toner by the respective developing devices 7 to the electrostatic latent images thus formed on the respective photoconductors 5, the electrostatic latent images are formed into visible images (visualized) as toner images.

Moreover, when the image forming operation is started, the second-transfer backup roller 32 is driven to rotate in a counterclockwise direction in the drawing, to rotate the intermediate transfer belt 30 in the direction indicated by the arrow in the drawing. To each of the first transfer roller 31, a constant voltage in an opposite polarity to the charged polarity of the toner or a voltage subjected to a constant current control is applied. Thus, a transfer electric field is formed at the first transfer nip between the first transfer rollers 31 and the photoconductors 5, respectively.

Thereafter, when the toner images of the respective colors on the photoconductors 5 reach the first transfer nips with rotation of the respective photoconductors 5, the toner images on the respective photoconductors 5 are sequentially transferred onto the intermediate transfer belt 30 to be overlapped with each other by the transfer electric fields formed on the first transfer nips described above. Thus, a toner image in full color is carried on the surface of the intermediate transfer belt 30. Toner that is not transferred to the intermediate transfer belt 30 and left on the respective photoconductors 5 is removed by the cleaning device 8. Thereafter, the surface of the respective photoconductors 5 are neutralized by an unillustrated neutralizing device, and the surface potential is initialized.

At a lower part of the image forming apparatus, the paper feeding roller 11 starts rotation driving, and the paper P is fed out from the paper feeding tray 10 to the transfer route R. The paper P fed out to the transfer route R is sent to the second transfer nip between the second transfer roller 36 and the second-transfer backup roller 32 at timing determined by the registration roller 12. At this time, a transfer voltage in an opposite polarity to the charged polarity of the toner of the toner image on the intermediate transfer belt 30 is applied to the second transfer roller 36, and thus a transfer electric field is formed at the second transfer nip.

Thereafter, when the toner image on the intermediate transfer belt 30 reaches the second transfer nip as the intermediate transfer belt 30 rotates, the toner image on the intermediate transfer belt 30 is collectively transferred onto the paper P by the transfer electric field formed at the nip. Toner that is not transferred to the paper P and left on the intermediate transfer belt 30 is removed by the belt cleaning device 35, and the removed toner is sent to an unillustrated waste toner container and collected therein.

Thereafter, the paper P is conveyed to the fixing device 20, and the toner image on the paper P is fixed on the paper P by the fixing device 20. The paper P is ejected to the outside of the apparatus by the paper ejection roller 13, and is stocked on the paper ejection tray 14.

Although the above explanation is about the image forming operation when a full color image is formed on paper, it is also possible to form a single color image by using either one of the four image forming units 4Y, 4M, 4C, and 4K, or to form a two-color image or three-color image by using two or three units of the image forming units.

Figure 2:
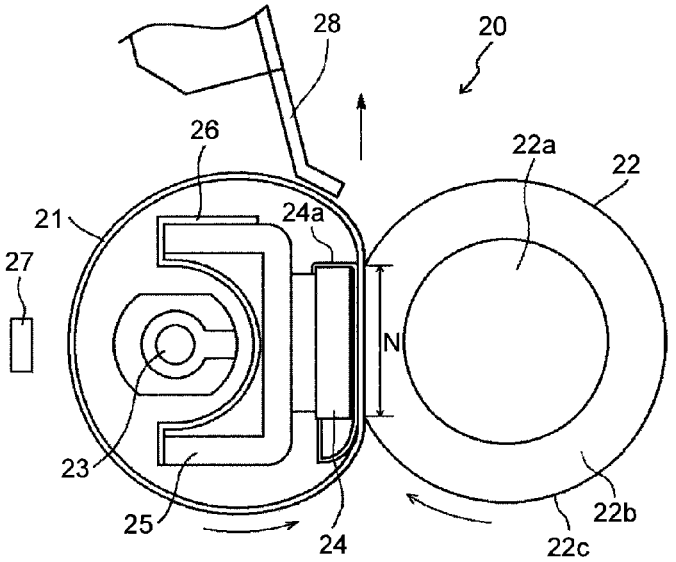
FIG. 2 is a cross section indicating one embodiment of a fixing device.

FIG. 2 is a cross section indicating one embodiment of the fixing device 20 described above.

As indicated in FIG. 2, the fixing device 20 has a fixing belt 21 as a rotatable fixing rotating member, a pressurizing roller 22 as an opposing rotating member that is rotatably arranged opposing to the fixing belt 21, a halogen heater 23 as a heat source to heat the fixing belt 21, a nip forming member 24 that is arranged on an inner side of the fixing belt 21, a stay 25 as a supporting member to support the nip forming member 24, a reflecting member 26 that reflects light radiated from the halogen heater 23 toward the fixing belt 21, a temperature sensor 27 as a temperature detecting unit to detect temperature of the fixing belt 21, a separating member 28 that separates paper from the fixing belt 21, and an unillustrated pressurizing unit that presses the pressurizing roller 22 to the fixing belt 21.

The fixing belt 21 described above is formed with an endless belt member (including a film) that is thin and flexible. Specifically, the fixing belt 21 is structured with a base that is made from a metallic material such as nickel and stainless steel (SUS) or a resin material such as polyimide (PI) on an inner peripheral side, and a mold release layer that is made of tetrafluoroetylene-perfluoroalkylvinylether copolymer (PFA), polytetrafluoroethylene (PTFE), or the like on an outer peripheral side. Furthermore, between the base and the mold release layer, an elastic layer that is made of a rubber material such as silicone rubber, foam silicone rubber, and fluororubber may be arranged.

The pressurizing roller 22 described above is structured with a core metal 22*a*, an elastic layer 22*b* that is formed on the surface of the core metal 22*a* and is made of foam silicone, silicone rubber, fluororubber, or the like, and a mold release layer 22*c* that is formed on the surface of the elastic layer 22*b* and is made of PFA, PTFE, or the like. The pressurizing roller 22 is pressed toward the fixing belt 21 by an unillustrated pressurizing unit to abut on the nip forming member 24 through the fixing belt 21. At a point at which this pressurizing roller 22 and the fixing belt 21 are pressurized to abut on each other, the elastic layer 22*b* of the pressurizing roller 22 is squeezed, thereby forming a nip N in a predetermined width. Moreover, the pressurizing roller 22 is configured to be rotated by an unillustrated driving source such as a motor equipped in the printer main unit. When the pressurizing roller 22 is rotated, the driving force is transmitted to the fixing belt 21 at the nip N, and the fixing belt 21 is rotated thereby.

Although the pressurizing roller 22 is a solid-core roller in the present embodiment, the pressurizing roller 22 may be a hollow-core roller. In that case, a heat source such as a halogen heater may be arranged inside the pressurizing roller 22. Moreover, if an elastic layer is not arranged, the thermal capacity decreases and the fixability improves; however, there is a possibility that minute asperities on the surface of the belt is reflected on an image at the time of fixing unfixed toner by applying pressure thereon and unevenness in glossiness can occur in a solid printing portion of the image. To prevent this phenomenon, it is desirable that an elastic layer having a thickness of 100 micrometer (μm) or more be arranged. By arranging an elastic layer having the thickness of 100 μm or more, minute asperities can be absorbed by elastic deformation of the elastic layer, and therefore, unevenness in glossiness can be avoided to occur. The elastic layer 22*b* may be of solid rubber; however when a heat source is not present inside the pressurizing roller 22, sponge rubber may also be used. Sponge rubber is preferable because the thermal insulation is higher, and heat of the fixing belt 21 is less easily lost. Furthermore, as for the fixing rotating member and the opposing rotating member it is not limited to be arranged to be pressurized to abut on each other, but a structure in which the fixing rotating member and the opposing rotating member are merely in contact with each other without applying pressure is also applicable.

In the halogen heater 23 described above, both ends thereof are fixed to a side plate (not illustrated) of the fixing device 20. The halogen heater 23 is configured to be controlled the output by a power source unit that is equipped in the printer main unit, to generate heat. The output control is performed based on a detection result of surface temperature of the fixing belt 21 acquired by the temperature sensor 27 described above. Such an output control of the halogen heater 23 enables adjustment of the temperature of the fixing belt 21 (fixing temperature) to desirable temperature. Moreover, as a heat source to heat the fixing belt 21, induction heating (IH), a resistance heating element, a carbon heater, or the like can be used other than the halogen heater.

The nip forming member 24 described above is arranged longitudinally along an axial direction of the fixing belt 21 or an axial direction of the pressurizing roller 22, and is supported by the stay 25 in a fixed manner. Thus, the nip forming member 24 is prevented from being bent by the pressure applied by the pressurizing roller 22, and a uniform nip width can be obtained in the axial direction of the pressurizing roller 22. Although it is desirable that the stay 25 be formed with a metallic material having high mechanical strength such as stainless steel and steel to satisfy a bent preventing function of the nip forming member 24, the stay 25 can also be formed with resin.

Furthermore, the nip forming member 24 is formed with a heat resistant member with heat resistant temperature of 200° C. or higher. Thus, deformation of the nip forming member 24 caused by heat is prevented in a toner-fixing temperature range, and a stable condition of the nip N is secured to stabilize the output image quality. Moreover, the nip forming member 24 has a low friction sheet 24*a* on a surface thereof. When the fixing belt 21 rotates, the fixing belt 21 slides over the low friction sheet 24*a*, and thus driving torque generated in the fixing belt 21 decreases, to reduce load caused by friction to the fixing belt 21.

The reflecting member 26 is arranged between the stay 25 and the halogen heater 23. In the present embodiment, the reflecting member 26 is fixed to the stay 25. Moreover, it is desirable that the reflecting member 26 be formed with a refractory metal or the like because the reflecting member 26 is directly heated by the halogen heater 23. By thus arranging the reflecting member 26, light radiated from the halogen heater 23 toward the stay 25 is reflected to the fixing belt 21. This enables to increase the amount of light irradiated to the fixing belt 21, and to heat the fixing belt 21 effectively. Furthermore, because radiant heat from the halogen heater 23 can be suppressed to be transmitted to the stay 25 and the like, an energy saving effect is also produced.

Moreover, without arranging the reflecting member 26 as one in the present embodiment, a surface of the stay 25 on a side of the halogen heater 23 may be processed into mirror finish by polishing or coating, to form a reflection surface. In addition, it is desirable that the reflectivity of the reflecting member 26 or the reflection surface of the stay 25 be 90% or higher.

However, to maintain the strength, the shape or material of the stay 25 cannot be selected flexibly, and therefore, if the reflecting member 26 is separately provided as in the present embodiment, flexibility in selecting the shape or material increases, and the reflecting member 26 and the stay 25 can be specialized in different functions. Furthermore, by arranging the reflecting member 26 between the halogen heater 23 and the stay 25, the fixing belt 21 can be effectively heated because the position of the reflecting member 26 is closer to the halogen heater 23.

Moreover, in the fixing device 20 according to the present embodiment, various kinds of structural contrivances are made for further energy-saving performance or improved first print time.

Specifically, the fixing belt 21 can be directly heated by the halogen heater 23 at a point other than the nip N (direct heating method). In the present embodiment, it is structured such that there is nothing between the halogen heater 23 and a portion on the left side of the fixing belt 21 in FIG. 2, and radiant heat from the halogen heater 23 is directly given to the fixing belt 21 at this part.

Furthermore, to lower the thermal capacity of the fixing belt 21, the fixing belt 21 is formed thin and in a small diameter. Specifically, the thickness of the base, the elastic layer, and the mold release layer are set within a range of 20 micrometers (μm) to 50 μm, 100 μm to 300 μm, and 10 μm to 50 μm, respectively, and the overall thickness is set to be 1 millimeter (mm) or less. Moreover, the diameter of the fixing belt 21 is set to 20 mm to 40 mm. To further lower the thermal capacity, it is preferable that the overall thickness of the fixing belt 21 be 0.2 mm or less, and is more preferable that the thickness be 0.16 mm or less. The diameter of the fixing belt 21 is preferable to be 30 mm or less.

In the present embodiment, the diameter of the pressurizing roller 22 is set to 20 mm to 40 mm, and is structured such that the diameter of the fixing belt 21 and the diameter of the pressurizing roller 22 are equivalent to each other. However, it is not limited to this structure. For example, the fixing belt 21 can be formed such that the diameter thereof is smaller than the diameter of the pressurizing roller 22. In that case, the curvature of the fixing belt 21 at the nip N is to be smaller than the curvature of the pressurizing roller 22, and therefore, a recording medium that is ejected from the nip N is easily separated from the fixing belt 21.

Figure 3:
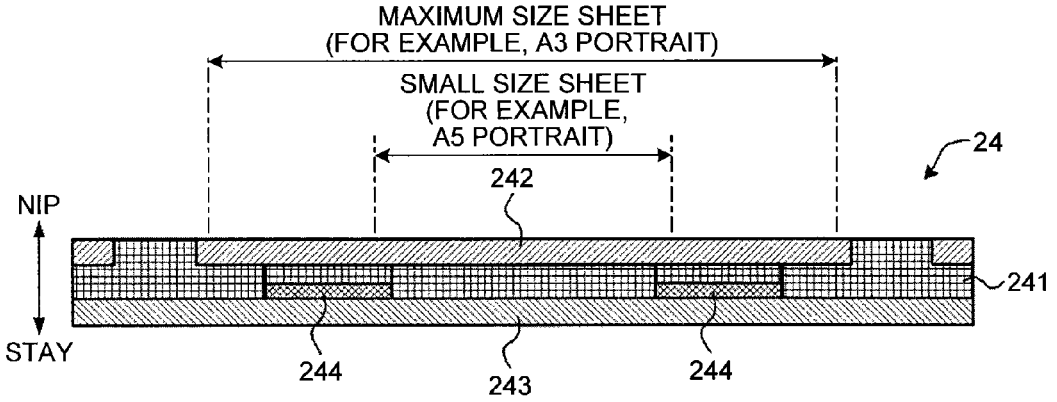
FIG. 3 indicates a structure of a nip forming member.
Figure 4:
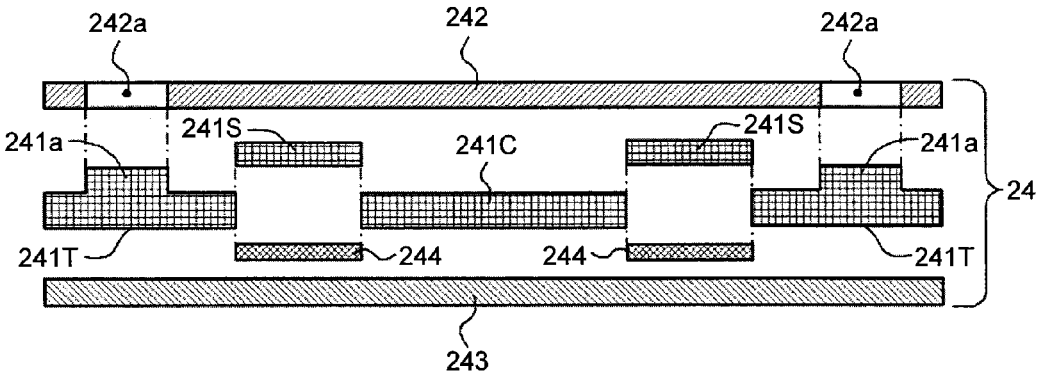
FIG. 4 is an exploded view of the nip forming member.

FIG. 3 indicates a structure of the nip forming member 24, and FIG. 4 is an exploded view thereof. FIG. 3 and FIG. 4 are front cross section (cross section area is a substantially central part (along an extended line between the temperature sensor 27 and the halogen heater 23) of the nip N in FIG. 2) when the nip forming member 24 is viewed from a paper conveying direction, and the horizontal direction in the drawing is the longitudinal direction (axial direction of the pressurizing roller), the upper side in the drawing is a nip side, and the lower side in the drawing is a side of the stay 25.

The nip forming member 24 indicated in FIGS. 3 and 4 is structured with a base 241, a nip-side high-thermal-conductive member 242, a stay-side high-thermal-conductive member 243, and an inner high-thermal-conductive member 244.

The base 241 is structured, as indicated in FIG. 4 in an exploded manner, with a center member 241C, two pieces of end members 241T, and two pieces of connecting members 241S. As the base 241, a general heat resistant resin such as polyethersulfone (PES), polyphenylenesulfide (PPS), liquid crystal polymer (LCP), polyether nitrile (PEN), polyamideimide (PAI), and polyether ether ketone (PEEK) can be suitably used.

The nip-side high-thermal-conductive member 242 is a high thermal conductive member that is arranged so as to cover a surface of the nip forming member 24 on the nip side, and a metal having high thermal conductivity such as copper (Cu) and aluminum (Al) can be suitably used. In the embodiment, copper (Cu) is used. The nip-side high-thermal-conductive member 242 is a member that is arranged farthest to the nip side, and that receives heat from a fixing member (the fixing belt 21 in the embodiment) directly (in more detail, through the low friction sheet 24*a* in the present embodiment). By arranging the nip-side high-thermal-conductive member 242 that is of a metallic material having high thermal conductivity such as copper (Cu) and aluminum (Al) in a paper width direction, for example, even if the temperature of the fixing member rises in a non-paper-passing region when small-sized sheets are continuously fed, the heat can be effectively shifted and scattered in the longitudinal direction (paper width direction), and so-called end temperature rise can be suppressed.

In the nip-side high-thermal-conductive member 242 of this example, a through holes 242*a* are formed near end portions on both sides in the longitudinal direction, and a convex portion 241*a* that is arranged in the end members 241T of the base 241 are engaged into the through holes 242*a*. Thus, it is structured such that an entire surface (front surface) of the nip forming member 24 on the nip side becomes flat.

The stay-side high-thermal-conductive member 243 is a high thermal conductive member that is arranged on a surface on the opposite side to the nip of the nip forming member 24 so as to be in contact with the stay 25 (FIG. 2), and a metal having high thermal conductivity such as copper (Cu) and aluminum (Al) can be suitably used similarly to the nip-side high-thermal-conductive member 242.

The inner high-thermal-conductive member 244 is a high thermal conductive member that is arranged between the stay-side high-thermal-conductive member 243 and the base 241 (the connecting member 241S in this example), and a metal having high thermal conductivity such as copper (Cu) and aluminum (Al) can be suitably used similarly to the other high-thermal-conductive members. The inner high-thermal-conductive member 244 in the longitudinal direction (direction of rotational axis of the fixing belt) is arranged at a position so as to correspond to an end of paper when a small-sized sheet (for example, A5 in portrait orientation) is fed, and is arranged such that an end portion of the inner high-thermal-conductive member 244 on a center side (center side in the longitudinal direction) overlaps with an end portion of a paper passing region of a small-sized sheet (for example, A5 in portrait orientation). By the inner high-thermal-conductive member 244 thus arranged, even if temperature rises near the end portion in the paper passing region when a small-sized sheets are continuously fed, the heat is effectively transmitted to the stay-side high-thermal-conductive member 243, to be scattered in the longitudinal direction (paper width direction) and a direction of thickness of the nip forming member 24 and absorbed therein.

To arrange the inner high-thermal-conductive member 244, the thickness (vertical direction in the drawing) of the base 241 at that portion is made thin, and in the illustrated example, it is arranged such that the thickness of the connecting member 241S and the inner high-thermal-conductive member 244 put together is equal to that of the center member 241C of the base.

Each of the high thermal conductive members have larger effect of preventing the end temperature rise as the thickness increases (becomes thicker); however, if the thickness is excessively thick, the warmup take longer and the energy efficiency is deteriorated. Therefore, in the present embodiment, the thickness of the stay-side high-thermal-conductive member 243 is 2 mm, the thickness of the inner high-thermal-conductive member 244 is 1.5 mm, and the thickness of the nip-side high-thermal-conductive member 242 is 0.6 mm. Moreover, in the base 241, the thickness of the connecting member 241S is 1 mm, the thickness of the center member 241C is 2.5 mm, which is the thickness of the connecting member 241S and the thickness of the inner high-thermal-conductive member 244. The thickness (thickness of only a projected portion) of the convex portion 241*a* of the base is 0.6 mm, which is the same as the thickness of the nip-side high-thermal-conductive member 242.

Furthermore, the nip-side high-thermal-conductive member 242 has length of 344 mm in an axial direction (longitudinal direction=paper width direction=horizontal direction of drawing), and has the through hole 242*a* having width (length in the axial direction) of 7.0 mm at a position that is 8.5 mm from the end portion. The through hole 242*a* is arranged such that an end portion thereof on the center side, that is, the end portion on a center side of the convex portion 241*a* of the base 241, is positioned outer side (closer to the end side) than an outer end of a paper passing region for a maximum feedable size.

Figure 10:
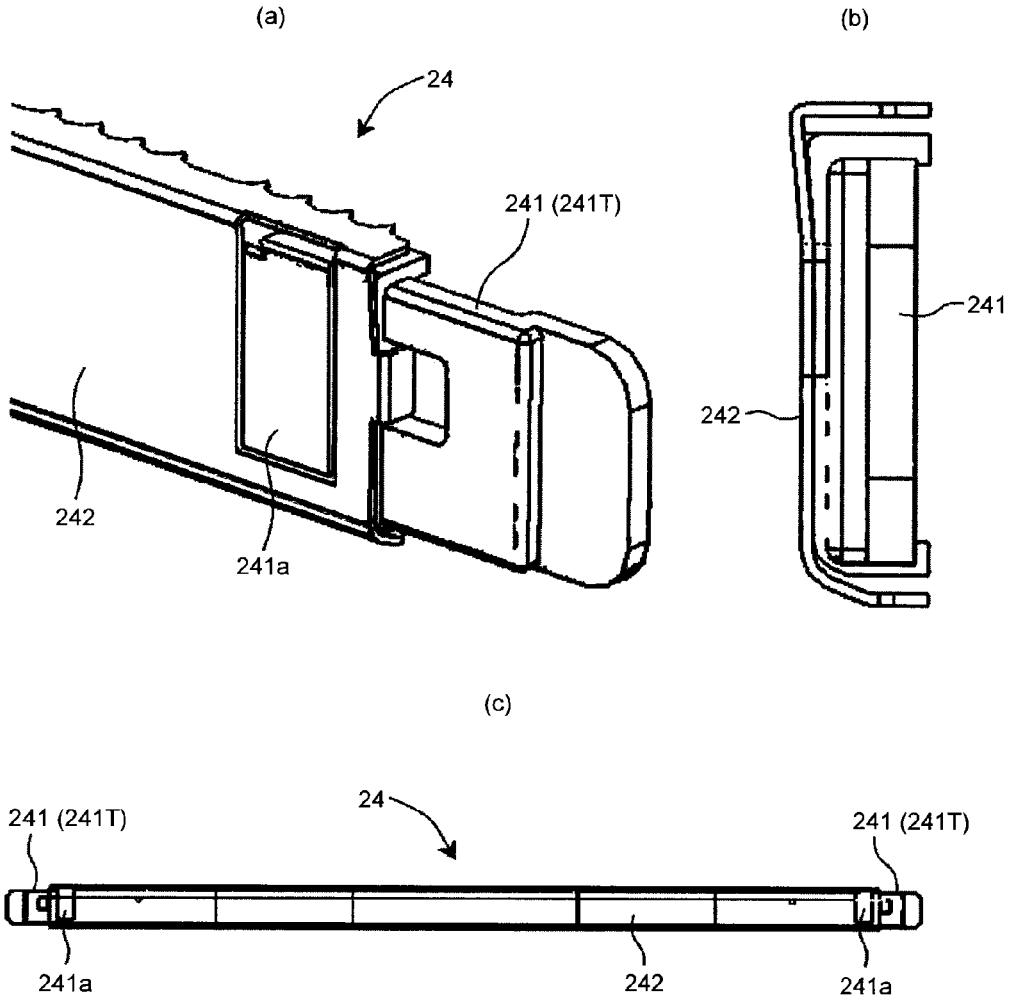
FIG. 10 shows three views indicating a specific form of the nip forming member.

In the drawing, the direction of thickness is exaggerated in illustration with respect to the direction of length. Moreover, FIGS. 3 and 4 are schematic diagrams to explain the structure of the nip forming member 24, and the respective parts are illustrated in sizes different from scaled down sizes of actual parts including the length. A specific shape of the nip forming member 24 is indicated in FIG. 10.

Figure 5:
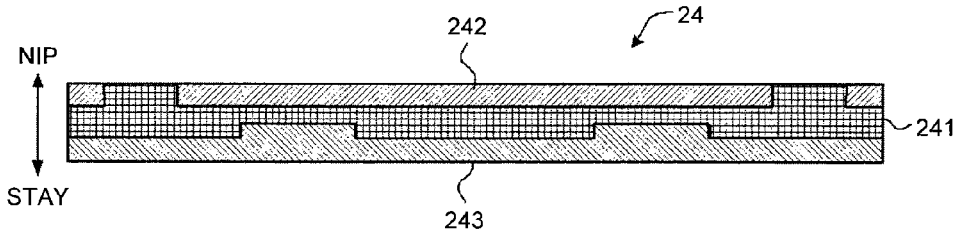
FIG. 5 indicates another example of a structure of the nip forming member.
Figure 6:
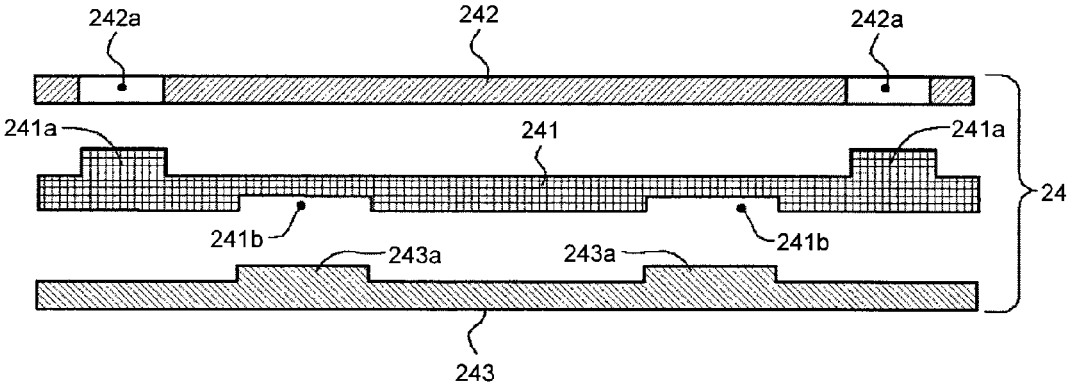
FIG. 6 is an exploded view thereof.

Although the base 241 is divided into multiple parts, and the inner high-thermal-conductive member 244 is arranged therein in the structure indicated in FIGS. 3 and 4, the base and the respective high thermal-conductive members may be structured with separated plate-shaped members, or with a member having convex and concave portions formed in one piece. In FIG. 5, a different example of a structure of the nip forming member 24 is illustrated. FIG. 6 is an exploded view thereof.

In the example of a structure indicated in FIGS. 5 and 6, the base 241 is structured with one piece of member in a shape having the convex portion 241*a* and a concave portion 241*b*. Furthermore, the inner high-thermal-conductive member 244 in FIG. 4 is omitted, and a one-piece member of the stay-side high-thermal-conductive member 243 that has a convex portion 243*a* corresponding thereto is used. The convex portion 243*a* has a shape that engages in the concave portion 241*b* tightly. The nip-side high-thermal-conductive member 242 is the same as that of FIGS. 3 and 4. The nip forming member 24 in which respective parts are combined has the completely same external form. Action of each part is also the same.

In the fixing device of the present embodiment configured as described above, the nip forming member 24 has a three-layer structure with a first high-thermal-conductive layer (heat-equalization layer) (nip-side heat-equalization layer=first heat-equalization layer), a base layer, and a second high-thermal-conductive layer (heat-equalization layer) (stay-side heat-equalization layer=second heat-equalization layer).

The nip-side high-thermal-conductive layer is formed with the nip-side high-thermal-conductive member 242 in most part (in a part, the convex portion 241*a* of the base 241 is engaged), and is a layer having high thermal conductivity (thermal conductivity is higher than the base layer), and is a part (heat-equalization layer) that equalizes, in the longitudinal direction (axial direction), heat from the fixing nip (fixing member) that is arranged on an outermost layer (nip side) of the nip forming member 24.

In the nip-side high-thermal-conductive layer, because the convex portion 241*a* of the base is engaged in a part thereof, the thermal conductivity in the longitudinal direction (axial direction) is not uniform, but there is a low thermal conductive portion near an end portion in the longitudinal direction (axial direction). With such a structure, even if temperature rises near an end portion of a paper passing region or in a non-paper-passing region when small-sized sheets are continuously fed when the fixing operation is performed, the heat is efficiently shifted and scattered in the longitudinal direction (paper width direction) by the equalization layer, and the heat becomes harder to be accumulated on the surface. Therefore, so-called end temperature rise at the time of continuous paper feeding can be effectively suppressed. At the same time, because of the low thermal conductive portion present near the end portion in the longitudinal direction (axial direction), heat loss to an end portion (end of a paper passing region) is limited, and the end temperature drop at the start of fixing can be suppressed.

Figure 8:
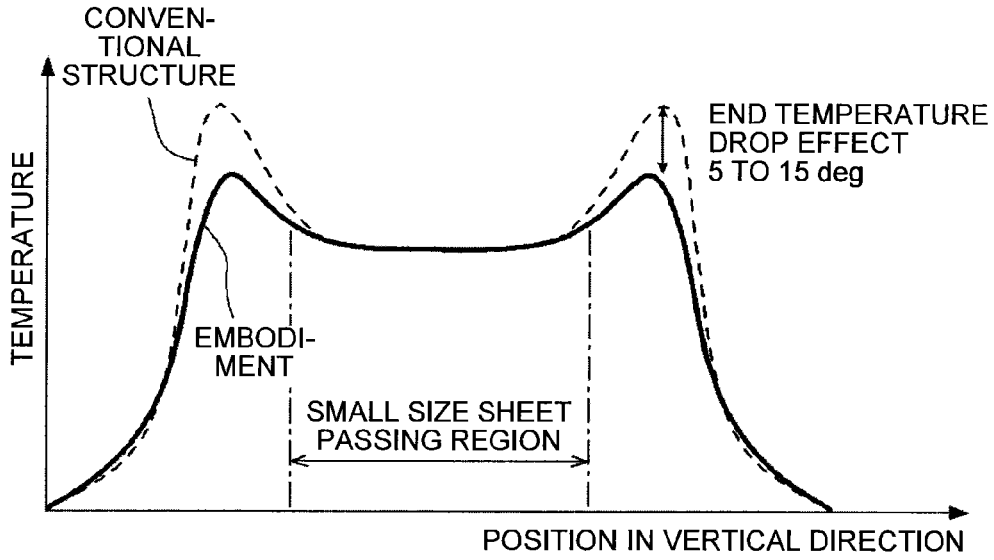
FIG. 8 is a graph indicating temperature of a nip portion when small-sized sheets are continuously fed.

FIG. 8 is a graph indicating temperature of a nip portion when small-sized sheets are continuously fed, and a vertical axis indicates temperature, and a horizontal axis indicates a position in the longitudinal direction (axial direction). Moreover, a solid line is for the fixing device of the embodiment of the invention, and a broken line is for one example of a fixing device in a conventional structure. As seen in this graph, while temperature rise occurs in a portion outside the paper passing region of a small-sized sheet in the conventional structure, temperature rise in a portion outside the paper passing region of a small-sized sheet is suppressed in the fixing device of the embodiment, and it has been confirmed that 5 degrees to 15 degrees of temperature reduction effect can be obtained in a confirmation experiment with the actual device.

Figure 9:
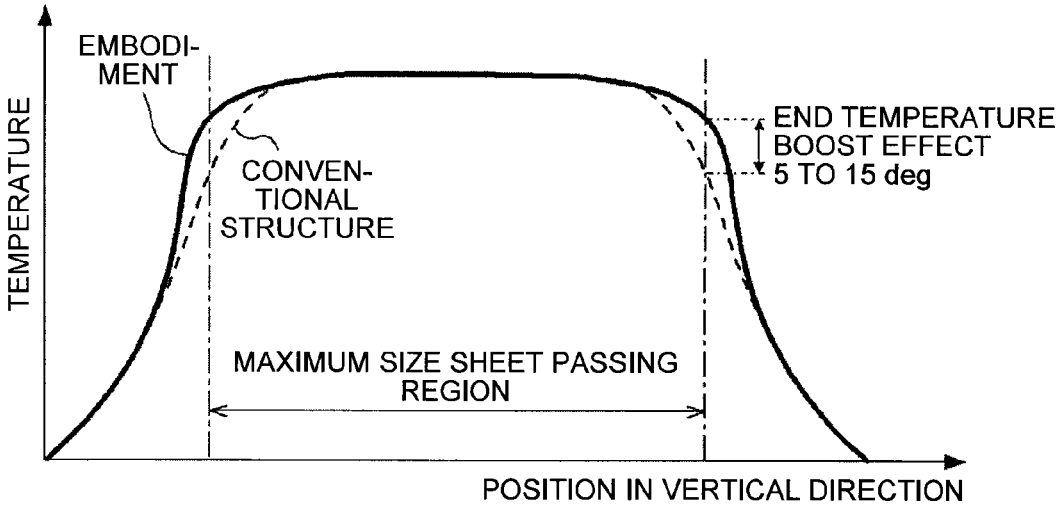
FIG. 9 is a graph indicating temperature of the nip portion when a large-sized sheet is fed at the time of activation.

Furthermore, FIG. 9 is a graph indicating temperature of the nip portion when a large-sized sheet (maximum feedable size, for example, A3 in portrait orientation) is fed at the time of activation, and a vertical axis indicates temperature and a horizontal axis indicates a position in the longitudinal direction (axial direction). Moreover, a solid line is for the fixing device of the embodiment of invention, and a broken line is for one example of a fixing device in a conventional structure. As seen in this graph, while temperature drop occurs near an end portion of the paper passing region in the conventional structure, temperature drop at the same part is suppressed in the fixing device of the embodiment. It has been confirmed that 5 degrees to 10 degrees of temperature boost effect can be obtained in a confirmation experiment with the actual device.

FIG. 10 shows three views indicating a specific form of the nip forming member 24, and FIG. 10(*a*) is a perspective view, FIG. 10(*b*) is a side view from the axial direction, and FIG. 10(*c*) is a plan view from the nip side. As described above, in the illustrated example, the nip-side high-thermal-conductive member 242 has length of 344 mm in the axial direction (longitudinal direction=paper width direction), and has the through hole 242*a* (FIG. 4) having width (length in the axial direction) of 7.0 mm at the position that is 8.5 mm from the end portion. The through hole 242*a* is arranged such that the end portion thereof on the center side, that is, the end portion on the center side of the convex portion 241*a* of the base 241, is positioned outer side (closer to the end side) than the outer end of a paper passing region for a maximum feedable size.

In the embodiment explained above, by arranging the through hole 242*a* in the nip-side high-thermal-conductive member 242, which is the high thermal-conductive layer to be the outermost layer (nip side) of the nip forming member 24, it is structured such that the thermal conductivity in the longitudinal direction (axial direction) of the high thermal-conductive layer is not uniform (nonuniform). However, the structure of making the thermal conductivity in the longitudinal direction of the high thermal-conductive layer nonuniform is not limited thereto, and an appropriate structure is applicable.

Figure 11:
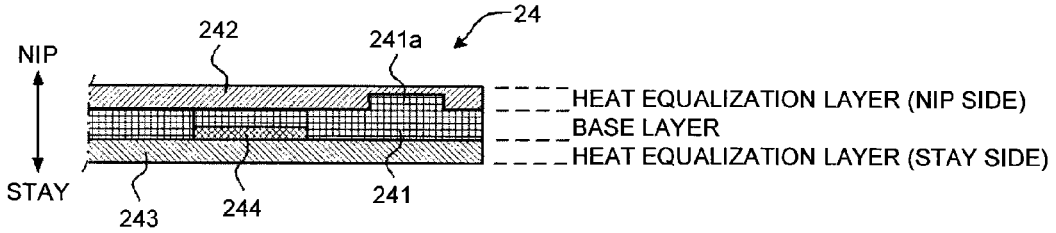
FIG. 11 indicates a layer structure of a nip forming member of a second example.

FIG. 11 indicates a second example of the nip forming member 24.

In this second example, a concave portion is arranged in the nip-side high-thermal-conductive member 242 instead of a through hole, and the convex portion 241*a* of the base 241 is formed to have lower height than a first example (FIGS. 3, 4) so as to correspond to the concave portion, and the convex portion 241*a* of the base 241 is engaged in the concave portion of the nip-side high-thermal-conductive member 242. Other structures are the same as those of the first example (FIGS. 3, 4) explained previously. Furthermore, as explained in FIGS. 5 and 6, the base 241 may be formed in a one-piece member, and a convex portion may be arranged in the stay-side high-thermal-conductive member 243, omitting the inner high-thermal-conductive member 244.

In the structure in FIG. 11 also, in the nip-side high-thermal-conductive layer to be the outermost layer (nip side) of the nip forming member 24, because the convex portion 241*a* of the base is engaged in a part thereof, the thermal conductivity in the longitudinal direction (axial direction) is not uniform, but there is a low thermal conductive portion near an end portion in the longitudinal direction (axial direction). With such a structure, even if temperature rises near an end portion of a paper passing region or in a non-paper-passing region when small-sized sheets are continuously fed when the fixing operation is performed, the heat is efficiently shifted and scattered in the longitudinal direction (paper width direction) by the high thermal-conductive layer, and the heat becomes harder to be accumulated on the surface. Therefore, so-called end temperature rise at the time of continuous paper feeding can be effectively suppressed. At the same time, because of the low thermal conductive portion present near the end portion in the longitudinal direction (axial direction), heat loss to an end portion (end of a paper passing region) is limited, and the end temperature drop at the start of fixing can be suppressed.

Although the nip forming member 24 explained above has a structure in which the high thermal-conductive layer (second equalization layer) having high thermal conductivity with respect to the base layer is arranged also on the stay side, a structure without a high thermal-conductive layer on the stay side is also possible. In that case, the base layer is arranged so as to be in contact with the stay 25.

Figure 12:
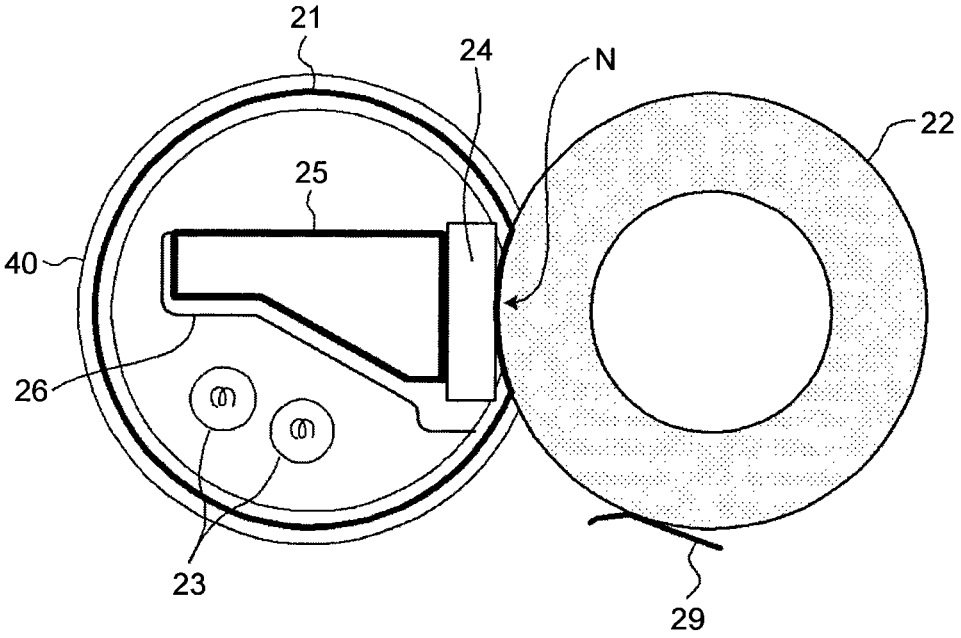
FIG. 12 is a schematic diagram indicating a second embodiment of the fixing device.

FIG. 12 is a schematic diagram indicating a second embodiment of the fixing device.

In the fixing device indicated in this drawing has the stay 25 (supporting member) to support the nip forming member 24 inside (inside the loop) the fixing belt 21 so that a bent of the nip forming member 24 that receives pressure from the pressurizing roller 22 is prevented and a uniform nip width is obtained in the axial direction. This stay 25 is held and fixed by unillustrated flanges at both ends in the axial direction, and thus positioned. Furthermore, the reflecting member 26 is arranged between the halogen heater 23, which is a heat source, and the stay 25, and wasting energy consumption by heating the stay 25 and the like with radiant heat from the halogen heater 23 is suppressed. Instead of arranging the reflecting member 26 as one in the present embodiment, by processing a surface of the stay 25 to have heat insulation or into a mirror finish, the same effect can be obtained. At a region in which the reflecting member 26 is not arranged, the fixing belt 21 is directly heated by the halogen heater 23. Similarly to the first embodiment, a low friction member (the low friction sheet 24*a*) may be arranged on a surface on which the nip forming member 24 slides on the fixing belt 21. Furthermore, as for positioning and fixing of the stay 25, instead of holding and fixing with the flanges at the ends of the stay 25 described above, the stay 25 may be held by an unillustrated side plate (frame) arranged in the fixing device.

The halogen heater 23 has a two-unit structure with one having a heat generating region in a central portion in the longitudinal direction corresponding to a small size, and one having a heat generating region at both ends in the longitudinal direction corresponding to a large size. As a heat source, it may be an illustrated halogen heater, but also an induction heating device, a resistance heating element, a carbon heater, or the like may be used.

Moreover, outside of the both end portions in the axial direction of the fixing belt 21, a slip ring 40 is arranged, to hold the fixing belt 21 in a preferable slidable state with respect to the belt. Furthermore, the contact temperature sensor 29 is arranged in the pressurizing roller 22. Two units of these contact temperature sensors 29 are arranged in a direction of roller axis, and detect temperature at a central portion and an end portion, respectively.

The nip forming member 24 is the same as the nip forming member 24 of the first embodiment explained previously, and also in the fixing device of the second embodiment, even if temperature rises near an end portion of a paper passing region or in a non-paper-passing region when small-sized sheets are continuously fed, the heat is efficiently shifted and scattered in the longitudinal direction (paper width direction) by the high thermal-conductive layer, and the heat becomes harder to be accumulated on the surface. Therefore, so-called end temperature rise at the time of continuous paper feeding can be effectively suppressed. At the same time, because of the low thermal conductive portion present near the end portion in the longitudinal direction (axial direction), heat loss to an end portion (end of a paper passing region) is limited, and the end temperature drop at the start of fixing can be suppressed.

Figure 13:
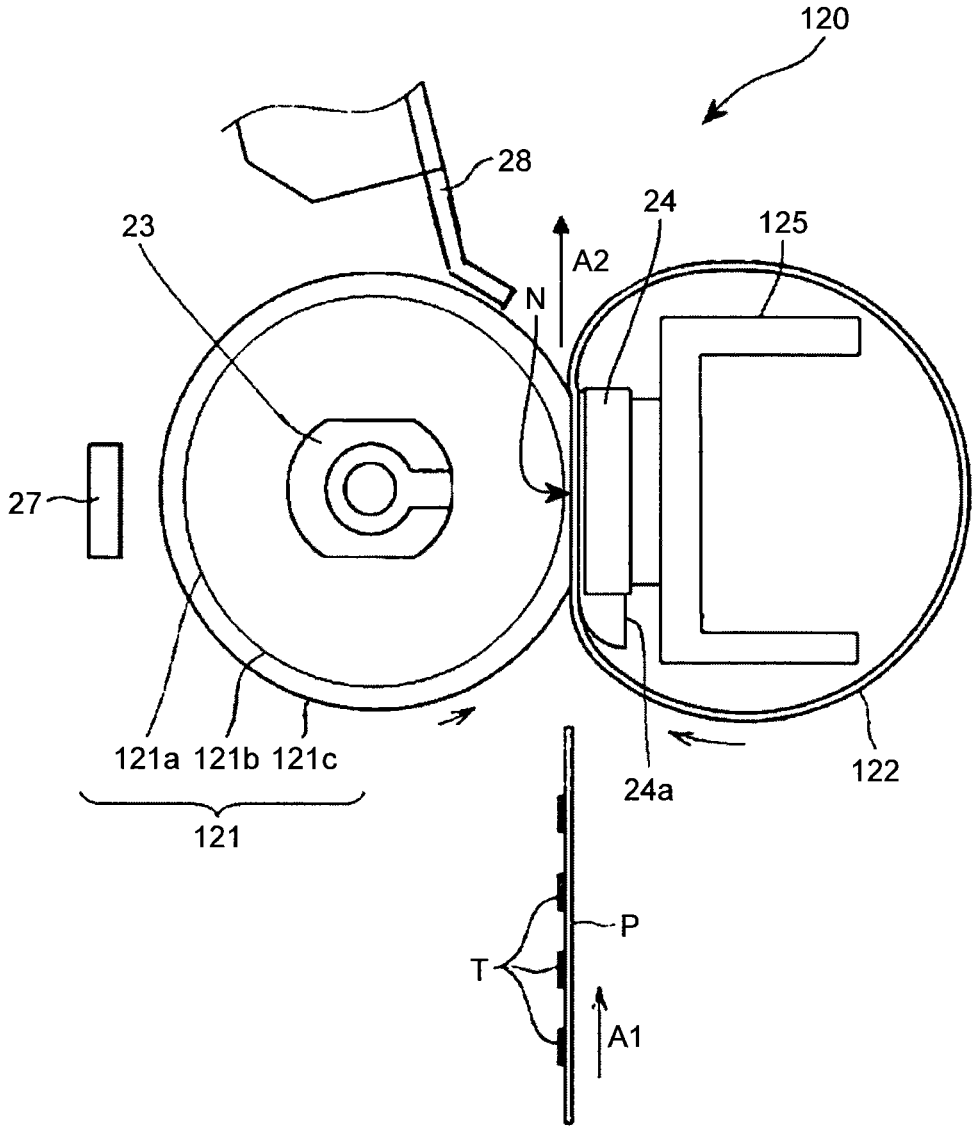
FIG. 13 is a schematic diagram indicating a third embodiment of the fixing device.

FIG. 13 is a schematic diagram indicating a third embodiment of the fixing device.

The fixing device 120 indicated in this drawing is one in which a nip forming member is arranged on a pressurizing side, and has a pressurizing belt 122 as a rotatable pressurizing rotating member, a fixing roller 121 as a fixing member that is rotatably arranged opposing to the pressurizing belt 122, the halogen heater 23 as a heat source to heat the fixing roller 121, the nip forming member 24 that is arranged on an inner side of the pressurizing belt 122, the stay 125 as a supporting member to support the nip forming member 24, the temperature sensor 27 as a temperature detecting unit to detect temperature of the fixing roller 121, the separating member 28 that separates paper from the fixing roller 121, an unillustrated pressurizing unit that presses the fixing roller 121 to the pressurizing belt 122, and the like.

The pressurizing belt 122 described above is formed with an endless belt member (including a film) that is thin and flexible. Specifically, the pressurizing belt 122 is structured with a base that is made from a metallic material such as nickel and SUS or a resin material such as polyimide (PI) on an inner peripheral side, and a mold release layer that is made of tetrafluoroetylene-perfluoroalkylvinylether copolymer (PFA), polytetrafluoroethylene (PTFE), or the like on an outer peripheral side. Furthermore, between the base and the mold release layer, an elastic layer that is made of a rubber material such as silicone rubber, foam silicone rubber, and fluororubber may be arranged.

The fixing roller 121 described above is structured with a pipe 121*a* that is made from a metal such as aluminum (Al) having high thermal conductivity, an elastic layer 121*b* that is formed on the surface of the pipe 121*a* and is made of foam silicone, silicone rubber, fluororubber, or the like, and a mold release layer 121*c* that is formed on the surface of the elastic layer 121*b* and is made of PFA, PTFE, or the like. The fixing roller 121 is pressed toward the pressurizing belt 122 by an unillustrated pressurizing unit to abut on the nip forming member 24 through the pressurizing belt 122. At a point at which this fixing roller 121 and the pressurizing belt 122 are pressurized to abut on each other, the elastic layer 121*b* of the fixing roller 121 is squeezed, thereby forming the nip N in a predetermined width. Moreover, the fixing roller 121 is configured to be rotated by an unillustrated driving source such as a motor equipped in the printer main unit. When the fixing roller 121 is rotated, the driving force is transmitted to the pressurizing belt 122 at the nip N, and the pressurizing belt 122 is rotated thereby.

Moreover, if an elastic layer is not arranged in the fixing roller, the thermal capacity decreases and the fixability improves; however, there is a possibility that minute asperities on the surface of the fixing roller is reflected on an image at the time of fixing unfixed toner by applying pressure thereon and unevenness in glossiness can occur in a solid printing portion of the image. To prevent this phenomenon, it is desirable that an elastic layer having the thickness of 100 micrometer (μm) or more be arranged. By arranging an elastic layer having the thickness of 100 μm or more, minute asperities can be absorbed by elastic deformation of the elastic layer, and therefore, unevenness in glossiness can be avoided to occur. As for the fixing roller and the pressurizing belt, it is not limited to be arranged to be pressurized to abut on each other, but a structure in which the fixing roller and the pressurizing belt are merely in contact with each other without applying pressure is also applicable.

In the halogen heater 23 described above, both ends thereof are fixed to a side plate (not illustrated) of the fixing device 120. The halogen heater 23 is configured to be controlled the output by a power source unit that is equipped in the printer main unit, to generate heat. The output control is performed based on a detection result of surface temperature of the fixing roller 121 acquired by the temperature sensor 27 described above. Such an output control of the halogen heater 23 enables adjustment of the temperature of the fixing roller (fixing temperature) to desirable temperature. Moreover, as a heat source to heat the fixing roller, IH, a resistance heating element, a carbon heater, or the like can be used other than the halogen heater.

The nip forming member 24 described above is arranged longitudinally along an axial direction of the pressurizing belt 122 or an axial direction of the fixing roller 121, and is supported by the stay 125 in a fixed manner. Thus, the nip forming member 24 is prevented from being bent by the pressure applied by the fixing roller 121, and a uniform nip width can be obtained in the axial direction of the fixing roller 121. Although it is desirable that the stay 125 be formed with a metallic material having high mechanical strength such as stainless steel and steel to satisfy a bent preventing function of the nip forming member 24, the stay 125 can also be formed with resin.

Furthermore, the nip forming member 24 is formed with a heat resistant member with heat resistant temperature of 200° C. or higher. Thus, deformation of the nip forming member 24 caused by heat is prevented in a toner-fixing temperature range, and a stable condition of the nip N is secured to stabilize the output image quality. For the nip forming member 24, a general heat resistant resin such as polyethersulfone (PES), polyphenylenesulfide (PPS), liquid crystal polymer (LCP), polyether nitrile (PEN), polyamideimide (PAI), and polyether ether ketone (PEEK) can be suitably used.

Moreover, the nip forming member 24 has a low friction sheet 24*a* on a surface thereof. When the pressurizing belt 122 rotates, the pressurizing belt 122 slides over the low friction sheet 24*a*, and thus driving torque generated in the pressurizing belt 122 decreases, to reduce load caused by friction to the pressurizing belt 122.

When a heat source, for example, a halogen heater, is arranged also inside the pressurizing belt 122 (inside loop), it is preferable that a reflecting member be arranged between the halogen heater and the stay 125. This enables to suppress wasting energy consumption by heating the stay 125 and the like with radiant heat from the halogen heater. Furthermore, instead of arranging a reflecting member, by processing a surface of the stay 125 to have heat insulation or into a mirror finish, the same effect can be obtained.

However, to maintain the strength, the shape or material of the stay 125 cannot be selected flexibly, and therefore, if a reflecting member is separately provided, flexibility in selecting the shape or material increases, and the reflecting member and the stay 125 can be specialized in different functions. Furthermore, by arranging a reflecting member between the halogen heater and the stay 125, the pressurizing belt 122 can be effectively heated because the position of the reflecting member is closer to the halogen heater.

In the present embodiment, the diameter of the fixing roller 121 is set to 20 mm to 40 mm, and is structured such that the diameter of the pressurizing belt 122 and the diameter of the fixing roller 121 are equivalent to each other. However, it is not limited to this structure. For example, the pressurizing belt 122 can be formed such that the diameter thereof is smaller than the diameter of the fixing roller 121. In that case, the curvature of the pressurizing belt 122 at the nip N is to be smaller than the curvature of the fixing roller 121, and therefore, a recording medium that is ejected from the nip N is easily separated from the pressurizing belt 122.

Figure 7:
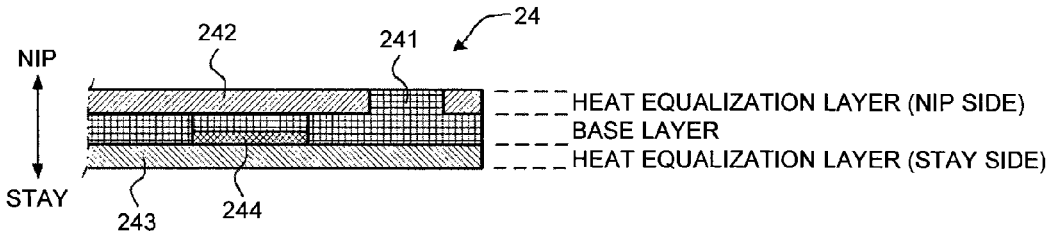
FIG. 7 indicates a layer structure of the nip forming member.

The nip forming member 24 has the same structure as that explained in the first embodiment, and is as explained in FIGS. 3 and 4, and 7. Because explanation duplicates, the explanation thereof is omitted herein. Furthermore, the structure explained in FIG. 5, 6 or FIG. 11 is also applicable.

By arranging the nip forming member 24 as described above, even if temperature rises near an end portion of a paper passing region or in a non-paper-passing region when small-sized sheets are continuously fed when the fixing operation is performed, the heat is efficiently shifted and scattered in the longitudinal direction (paper width direction) by the high thermal-conductive layer, and the heat becomes harder to be accumulated on the surface. Therefore, so-called end temperature rise at the time of continuous paper feeding can be effectively suppressed. At the same time, because of the low thermal conductive portion present near the end portion in the longitudinal direction (axial direction), heat loss to an end portion (end of a paper passing region) is limited, and the end temperature drop at the start of fixing can be suppressed.

With the fixing device 120 of the third embodiment also, similarly to explanation about the first embodiment in FIG. 8, temperature rise at a portion outside the paper passing region for a small size is suppressed, and it has been confirmed that 5 degrees to 15 degrees of temperature reduction effect can be obtained in a confirmation experiment with the actual device.

Furthermore, in the case of feeding a large-sized sheet (maximum feedable size, for example, A3 in portrait orientation) at the time of activation also, similarly to the explanation about the first embodiment in FIG. 9, temperature drop near an end portion of the paper passing region can be suppressed. It has been confirmed that 5 degrees to 10 degrees of temperature boost effect can be obtained in a confirmation experiment with the actual device.

For example, the number or an arranging position of the heat source of the fixing device are arbitrarily determined, and the heat source is not limited to a halogen heater, but an appropriate heat source including an induction heating unit is applicable. As for a material of a belt or film as a fixing member, a structure of a pressurizing member, or the like also, appropriate ones can be adopted.

For the structure of the nip forming member also, an appropriate structure can be adopted, and a material thereof is also appropriately selected considering accost, manufacturability, and the like.

Furthermore, a configuration of the image forming apparatus is also arbitrary, and it is not limited to one using toner of four colors, and the present invention is applicable to a full-color machine using toner of three colors, a multi-color machine with toner of two colors, or a monochrome apparatus. The image forming apparatus is, of course, not limited to a printer, and it may be a copier, a facsimile, or a multifunction machine having multiple functions.

According to the present invention, even if temperature rises near an end portion of a paper passing region or in a non-paper-passing region when small-sized sheets are continuously fed, the heat is efficiently shifted and scattered in the longitudinal direction (paper width direction) by a high thermal-conductive layer (equalization layer), and the heat becomes harder to be accumulated on a surface. Therefore, so-called end temperature rise at the time of continuous paper feeding can be effectively suppressed. At the same time, because of a low thermal conductive portion present near the end portion in the longitudinal direction, heat loss to an end portion is limited, and the end temperature drop at the start of fixing can be suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device, comprising:

a fixing member that is rotatable and in an endless shape;

a heat source that heats the fixing member;

a nip forming member that is arranged inside the fixing member; and a pressurizing member that is pressurized to be in contact with the nip forming member through the fixing member, to form a fixing nip, and the fixing device fixing an unfixed image on a recording medium by passing the recording medium that carries the unfixed image through the fixing nip, wherein the nip forming member includes a base layer, and a high thermal-conductive layer that is arranged on a surface layer of the base layer on a fixing nip side, and that has higher thermal conductivity than the base layer, in the high thermal-conductive layer, a low thermal-conductive portion is arranged near an end portion in an axial direction of the fixing member, and the low thermal-conductive portion is structured by engaging a convex portion arranged in the base layer into a through hole arranged in the high thermal-conductive layer.

2. The fixing device according to claim 1, wherein the low thermal-conductive portion is arranged on an outer side of a paper passing region of paper in a maximum size.

3. The fixing device according to claim 1, wherein a high thermal-conductive member is arranged, in the base layer, near an end portion on an outer side of a paper passing region of predetermined small-sized paper.

4. The fixing device according to claim 3, wherein the high thermal-conductive member is arranged on an opposite side to the fixing nip of the base layer.

5. The fixing device according to claim 1, wherein the base layer is structured with a plurality of divided members.

6. The fixing device according to claim 1, wherein a second high thermal-conductive layer having higher thermal conductivity than the base layer is arranged on an opposite side to the fixing nip of the base layer.

7. The fixing device according to claim 1, wherein the heat source directly heats the fixing member.

8. The fixing device according to claim 1, further comprising a supporting member that supports the nip forming member, wherein a reflecting member that reflects heat from the heat source is arranged between the supporting member and the heat source.

9. An image forming apparatus comprising the fixing device of claim 1.

10. A fixing device, comprising:

a pressurizing rotating member that is rotatable and in an endless shape;

a nip forming member that is arranged inside the pressurizing rotating member;

a fixing member that is pressurized to abut on the nip forming member through the pressurizing rotating member, to form a fixing nip between itself and the pressurizing rotating member; and a heat source that heats the fixing member, and the fixing device fixing an unfixed image on a recording medium by passing the recording medium that carries the unfixed image through the fixing nip, wherein the nip forming member includes a base layer, and a high thermal-conductive layer that is arranged on a surface layer of the base layer on a fixing nip side, and that has higher thermal conductivity than the base layer, in the high thermal-conductive layer, a low thermal-conductive portion is arranged near an end portion in an axial direction of the fixing member, the low thermal-conductive portion is structured by engaging a convex portion arranged in the base layer into a through hole arranged in the high thermal-conductive layer.

11. The fixing device according to claim 10, wherein the low thermal-conductive portion is arranged on an outer side of a paper passing region of paper in a maximum size.

12. The fixing device according to claim 10, wherein a high thermal-conductive member is arranged, in the base layer, near an end portion on an outer side of a paper passing region of predetermined small-sized paper.

13. The fixing device according to claim 12, wherein the high thermal-conductive member is arranged on an opposite side to the fixing nip of the base layer.

14. The fixing device according to claim 10, wherein the base layer is structured with a plurality of divided members.

15. The fixing device according to claim 10, wherein a second high thermal-conductive layer having higher thermal conductivity than the base layer is arranged on an opposite side to the fixing nip of the base layer.

16. The fixing device according to claim 10, wherein the heat source directly heats the fixing member.

* * * * *